United States Patent [19]

Tada et al.

[11] 4,358,769

[45] Nov. 9, 1982

[54] LOOP ANTENNA APPARATUS WITH VARIABLE DIRECTIVITY

[75] Inventors: Masahiro Tada, Yokohama; Hirokazu Ichikawa, Hiratsuka; Mitsuo Fukushima, Tokyo; Koya Nakamichi; Koji Ouchi, both of Yokohama; Yoshio Ishigaki, Tokyo, all of Japan

[73] Assignee: Sony Corporation, Tokyo, Japan

[21] Appl. No.: 233,387

[22] Filed: Feb. 11, 1981

[30] Foreign Application Priority Data

Feb. 15, 1980 [JP] Japan ..... 55/18071

[51] Int. Cl.[3] ..... H01Q 11/12

[52] U.S. Cl. ..... 343/742; 343/743; 343/741

[58] Field of Search ..... 343/742, 743, 744, 741, 343/702

[56] References Cited

U.S. PATENT DOCUMENTS 2,650,303 8/1953 Schlesinger ..... 343/743

4,169,265 9/1979 Howell et al. ..... 343/742

*Primary Examiner*—David K. Moore

*Attorney, Agent, or Firm*—Hill, Van Santen, Steadman, Chiara & Simpson

[57] ABSTRACT

A loop antenna apparatus is disclosed which includes a main conductive loop arranged on a first surface, a plurality of supplemental conductive loops connected to the main conductive loop and arranged on different surfaces from the first surface, respectively, a plurality of signal feeding points provided in different loops of the main and supplemental conductive loops, an output terminal and change-over switches for selectively connecting one of the plurality of signal feeding points to the output terminal.

4 Claims, 33 Drawing Figures

FIG. 24A "a" Output

FIG. 24B "b" Output

FIG. 24C "c" Output

FIG. 24D "d" Output

LOOP ANTENNA APPARATUS WITH VARIABLE DIRECTIVITY

BACKGROUND OF THE INVENTION

1. Field of the Invention

The present invention relates generally to a loop antenna apparatus suitable for use as a room antenna, and more particularly to a loop antenna apparatus which has a broad band and whose directivity and directivity characteristic can be easily changed over.

2. Description of the Prior Art

In the prior art, there have been proposed various types of loop antenna apparatus as a room antenna, such as a table type structure located on a television cabinet, a wall type structure set on a wall near the television cabinet or the like. However, with the prior art loop antenna apparatus for use in a room, generally it does not have sufficient gain for an input electric wave at the broad frequency band thereof, and also the directivity and directivity characteristic thereof can not be easily changed over. Further, the prior art loop antenna apparatus has a defect in that it is large in size and thus requires a great deal of space.

OBJECTS AND SUMMARY OF THE INVENTION

Accordingly, an object of the present invention is to provide a specific loop antenna apparatus in which the directivity and its characteristic can be easily varied.

Another object of the invention is to provide a loop antenna apparatus with variable directivity which has a high gain at the broad frequency band of an input electric wave.

A further object of the invention is to provide a loop antenna apparatus with variable directivity which is simple in structure and saves space.

According to an aspect of the present invention, there is provided a loop antenna apparatus which comprises:

a main conductive loop arranged on a first surface;

a plurality of supplemental conductive loops connected to said main conductive loop and arranged on different surfaces than said first surface, respectively;

a plurality of signal feeding points provided in different loops of said main and supplemental conductive loops;

an output terminal; and means for selectively connecting one of said plurality of signal feeding points to said output terminal.

The other objects, features and advantages of the present invention will become apparent from the following description taken in conjunction with the accompanying drawings through which the like references designate the same elements and parts.

DESCRIPTION OF THE PREFERRED EMBODIMENTS

Now, the present invention will be hereinafter described with reference to the attached drawings where the invention is applied, by way of example, to a room television antenna (receiving antenna) apparatus.

Figure 1:
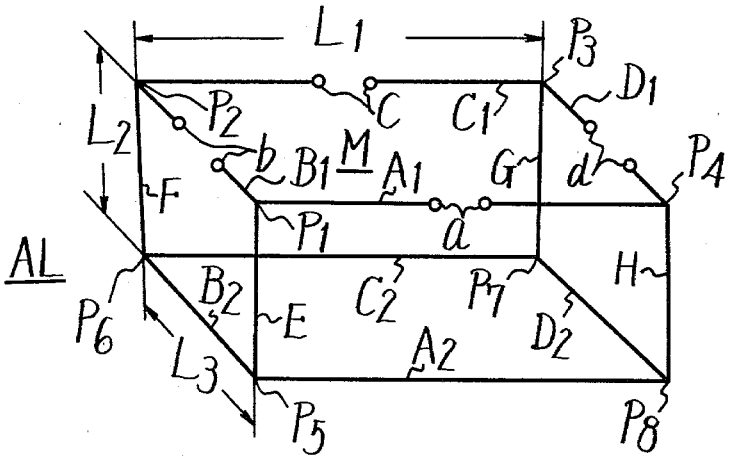
FIG. 1 is a perspective view showing the antenna conductive portion of an example of the loop antenna apparatus according to the present invention.
Figure 2:
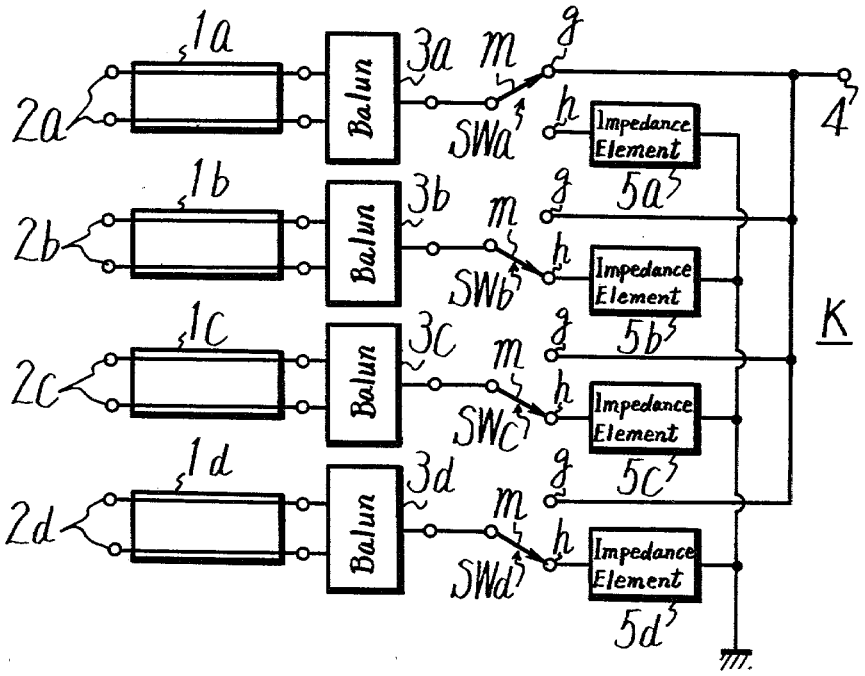
FIG. 2 is a connection diagram showing, partially in block, an example of the signal feeding circuit for use with the loop antenna apparatus shown in FIG. 1.

FIG. 1 is a view showing an antenna conductive portion AL of an example of the antenna apparatus according to the invention, and FIG. 2 is a signal feeding circuit K which is connectable to a plurality of feeding points of the antenna apparatus shown in FIG. 1.

The antenna conductive portion AL shown in FIG. 1 is formed of conductors $A_1$, $B_1$, $C_1$, $D_1$, E, F, G, H, $A_2$, $B_2$, $C_2$ and $D_2$ corresponding to twelve edges of a rectangular parallelepiped. In this case, the conductors $A_1$ to $D_1$ are sequentially connected to form a rectangular loop, and the conductors $A_2$ to $D_2$ are also sequentially connected to form a rectangular loop. Between a connection point $P_1$ of the conductors $A_1$ and $B_1$ and a connection point $P_5$ of the conductors $A_2$ and $B_2$, connected is the conductor E, similarly between a connection point $P_2$ of the conductors $B_1$ and $C_1$ and a connection point $P_6$ of the conductors $B_2$ and $C_2$; between a connection point $P_3$ of the conductors $C_1$ and $D_1$ and a connection point $P_7$ of the conductors $C_2$ and $D_2$; and between a connection point $P_4$ of the conductors $D_1$ and $A_1$ and a connection point $P_8$ of the conductors $D_2$ and $A_2$ respectively connected are the conductors F, G and H. In this case, it be assumed that the lengths of the conductors $A_1$, $A_2$, $C_1$ and $C_2$ are selected equal as $L_1$; the lengths of the conductors E, F, G and H are selected equal as $L_2$; and the lengths of the conductors $B_1$, $B_2$, $D_1$ and $D_2$ are selected also equal as $L_3$, respectively.

In the example shown in FIG. 1, the conductors $A_1$, $B_1$, $C_1$ and $D_1$ form a main antenna conductor M of a loop shape which forms a main loop, and the conductors E, F, G, H and those $A_2$, $B_2$, $C_2$ and $D_2$ form a plurality of supplemental antenna conductors which are directly or indirectly connected to the main antenna conductor M to form a plurality of supplemental loops which are respectively contained or arranged on a plurality of surfaces different from that on which the main loop is contained or arranged. For example, the conductors E, $A_2$ and H form a sub-antenna conductor which forms a certain supplemental loop in cooperation with the conductor $A_1$ of the main antenna conductor M. Also, the conductors E, $A_2$, $D_2$ and G form another sub-antenna conductor which forms another supplemental loop in cooperation with the conductors $A_1$ and $D_1$ of the main antenna conductor M. In addition thereto, there are some supplemental loops, but their explanation will be omitted.

In FIG. 1, reference letters a, b, c and d represent feeding points respectively and they are each provided at substantially center portions of the respective conductors $A_1$ to $D_1$ of the main antenna conductor M which are changed over as will be described later. One of these feeding points a to d is selected and then connected to an output terminal (or input terminal in the case of a transmission antenna), while the remaining feeding points are short-circuited, opened or connected with appropriate impedance elements.

Turning to FIG. 2, an example of the signal feeding circuit K to be connected to the feeding points a to d of the antenna conductive portion AL shown in FIG. 1 will be described. In FIG. 2, references 1*a* 1*b*, 1*c* and 1*d* respectively designate feeders each operating as a distributed constant transmission line which are balanced type feeders with the characteristic impedance of 300Ω. In this case, respective input terminals 2*a*, 2*b*, 2*c* and 2*d* of feeders 1*a* to 1*d* should be respectively connected to the feeding points a to d in FIG. 1. The respective output terminals of the feeders 1*a* to 1*d* are respectively connected to the balanced input terminals of balance to unbalance conversion type baluns 3*a*, 3*b*, 3*c* and 3*d* where the input impedance of each of the baluns 3*a* to 3*d* is selected as 300Ω while the output impedance thereof is selected as 75Ω. The respective unbalanced output terminals of the baluns 3*a* to 3*d* are respectively connected to movable contacts m of change-over switches $SW_a$, $SW_b$, $SW_c$ and $SW_d$ each having fixed contacts g and h. The one fixed contacts g of the respective switches $SW_a$ to $SW_d$ are connected common to an output terminal 4, while the remaining fixed contacts h thereof are respectively grounded through terminal impedance elements 5*a*, 5*b*, 5*c* and 5*d*. In this case, the switches $SW_a$ to $SW_d$ are changed over in ganged relation with one another such that a certain desired one of these switches is changed over so that its movable contact m is connected to its fixed contact g while all the remaining switches are changed over so that their movable contacts m are connected to their fixed contacts h, respectively.

Now, description will be given of the function and operation of the above-mentioned loop antenna apparatus. In general, an input impedance $Z_{in}$ viewed from the input terminal 2*a* of the feeder 1*a* to the feeder 1*a* is expressed as follows:

$$Z_{in} = W\frac{Z_r \cos\beta' l + jW \cdot \sin\beta' l}{W \cdot \cos\beta' l + jZ_r \cdot \sin\beta' l} \quad (1)$$

where W is the characteristic impedance (300Ω here) of the respective feeders 1*a* to 1*d*; $Z_r$ is the value as 4 times the impedance of the respective terminal impedance elements 5*a* to 5*d* (accordingly, the impedance of the impedance elements 5*a* to 5*d* becomes $Z_r/4$); $\beta'$ is the propagation constant of the respective feeders 1*a* to 1*d* (where $\beta'=2\pi/0.86\lambda$, λ is the wave length of the signal and 0.86 is the constant determined by the ratio of effective wave length to free space wave length); and l is the effective length of the respective feeders 3*a* to 3*d* including the baluns 3*a* to 3*d* (the value provided by multiplying the length of the feeders 1*a* to 1*d* including the baluns 3*a* to 3*d* with the constant 0.86). The input impedance $Z_{in}$ is of course changed in response to the frequency of an input signal.

For example, when the frequency of the input signal is 100 $MH_z$ (accordingly, its wave length is 300 cm), if l is so selected that $\beta' l$ becomes $\pi/2$, l is expressed as follows:

$$l = \frac{\pi}{2}\cdot\frac{1}{\beta'} = \frac{\pi}{2}\cdot\frac{0.86\lambda}{2\pi} = \frac{0.86\times 300}{4} = 64.5\ (\text{cm}) \quad (2)$$

Further, the lengths $L_1$, $L_2$ and $L_3$ shown in FIG. 1 are respectively selected so as to satisfy the equations relating to the theoretical resonant frequency of the following loop antenna.

$$V_c/(2L_1+2L_2+4L_3)=75\ (MH_z) \quad (3)$$

$$V_c/(2L_1+2L_2+2L_3)=100\ (MH_z) \quad (4)$$

$$V_c/(2L_1+2L_3)=130\ (MH_z) \quad (5)$$

$$V_c/(2L_2+2L_3)=180\ (MH_z) \quad (6)$$

where $V_c$ is the velocity of light. Thus, $L_1 \approx 73$ cm and $L_2=L_3 \approx 42$ cm.

Now, descrption will be given of how the current is distributed to the antenna conductive portions and which directivity characteristic is presented in the antenna apparatus in accordance with the difference in frequency of an incoming or outgoing electric wave.

Figure 3:
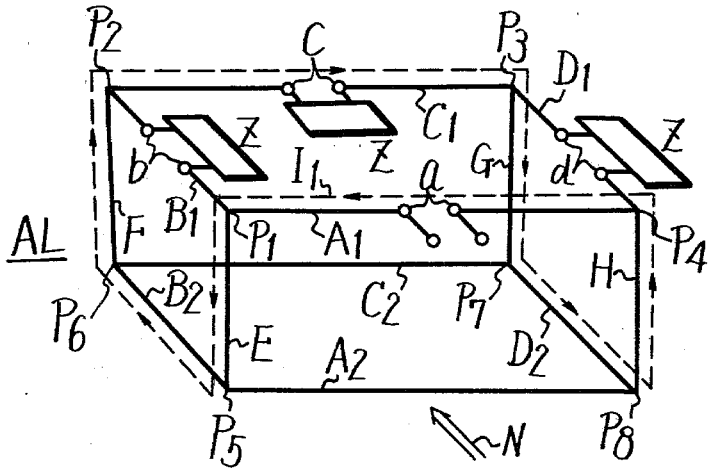
FIGS. 3, 5, 6, 8, 9, 11, 13, 14, 16, 17, 19 and 20 are respectively perspective views each used to explain the operation of the antenna conductive portion of the present invention.

FIG. 3 shows a case where the point a is selected as the feeding point, an incoming electric wave with the frequency of about 75 $MH_z$ arrives perpendicular to the plane including the connection points $P_1$, $P_4$, $P_8$ and $P_5$ as indicated by an arrow N and the plane of polarization of the electric field is parallel to the conductor $A_1$. At this time, $\beta' l$ become $0.375\pi$ ($\beta' l=0.375\pi$), and $Z_r$ is set as zero ($Z_r=0$). Also, W is 300Ω as set forth above. In this case, $Z_{in}$ expressed by the equation (1) becomes as follows:

$$Z_{in} = j\,W \tan\beta' l = j\,724\ (\Omega) \quad (7)$$

Accordingly, an impedance element with the impedance of Z=j724Ω is equivalently connected to each of an feeding points b, c and d.

Figure 4:
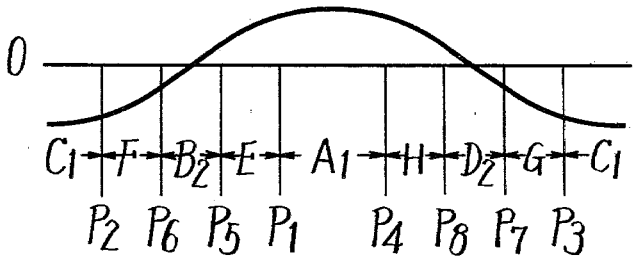
FIGS. 4, 7, 10, 12, 15, 18 and 21 are respectively graphs each showing the current distribution of the antenna conductive portion of the invention.

In this case, a current $I_1$ flows through the closed loop consisting of the conductors $A_1$-E-$B_2$-F-$C_1$-G-$D_2$-H-$A_1$ as shown in FIG. 3 and the current distribution thereof becomes as shown in the graph of FIG. 4. Thus just one wavelength of the current with the frequency of 75 $MH_z$ is distributed. As will be apparent from the graph of FIG. 4, at the center portion of each of the conductors $A_1$ and $C_1$, the current $I_1$ presents the positive and negative peaks, respectively, and at the center portion of each of the conductors $B_2$ and $D_2$ the current $I_1$ becomes zero respectively.

Figure 5:
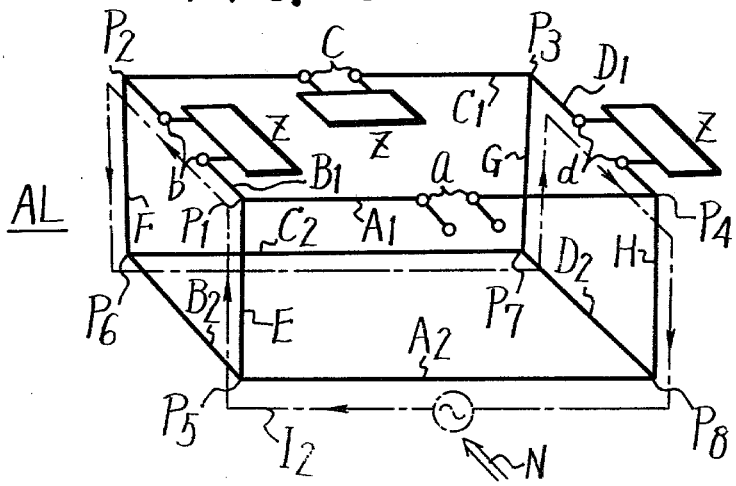

Further, at this time, a current $I_2$ flows through the closed loop consisting of the conductors $A_2$-E-$B_1$-F-$C_2$-G-$D_1$-H-$A_2$ as shown in FIG. 5. As shown in FIG. 3, only one impedance element Z is inserted into the closed loop through which the current $I_1$ flows, while two impedance elements Z are inserted into the closed loop through which the current $I_2$ flows as shown in FIG. 5. Therefore, $I_1 > I_2$ is established. For this reason, if the current $I_2$ is neglected, the closed loop through which the current $I_1$ flows as shown in FIG. 3 forms a loop antenna.

Figure 6:
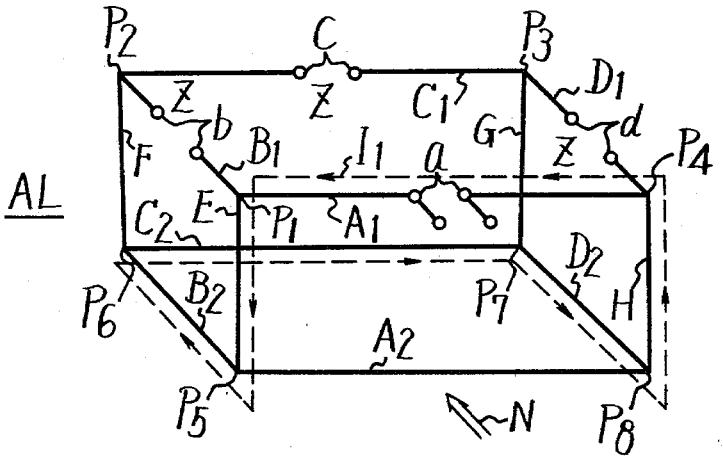

FIG. 6 shows a case where the point a is selected as the feeding point, an incoming electric wave with the frequency of about 100 $MH_z$ arrives perpendicular to the plane including the connection points $P_1$, $P_4$, $P_8$ and $P_5$ as indicated by an arrow N and the plane of polarization of the electric field is parallel to the conductor $A_1$.

At this time, $\beta'l$ becomes $0.5\pi(\beta'l=0.5\pi)$ as set forth above and $Z_r$ is set zero ($Z_r=0$) similarly. Also, W is 300Ω as described above. Thus, $Z_{in}$ of the equation (1) becomes as follows:

$$Z_{in} = j\,W \tan \beta' l = \infty\ (\Omega) \tag{8}$$

Accordingly, an impedance element with the impedance $Z=\infty(\Omega)$ is equivalently connected to each of the feeding points b, c and d, namely each of these feeding points is opened.

Figure 7:
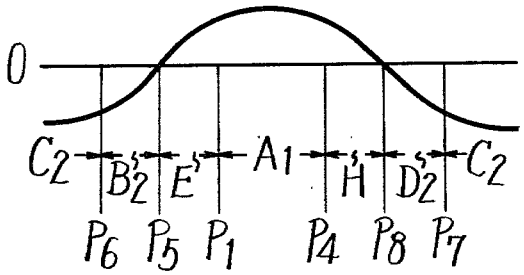

In this case, as shown in FIG. 6, a current $I_1$ flows through the closed loop consisting of the conductors $A_1$-E-$B_2$-$C_2$-$D_2$-H-$A_1$ and the current distribution thereof becomes as shown in the graph of FIG. 7, namely just one wavelength of the current with a frequency of 100 $MH_z$ is distributed. From the graph of FIG. 7, it will be clear that the current $I_1$ presents the positive and negative peaks at the center portions of the conductors $A_1$ and $C_2$ and becomes zero at the connection points $P_5$ and $P_8$, respectively.

Figure 8:
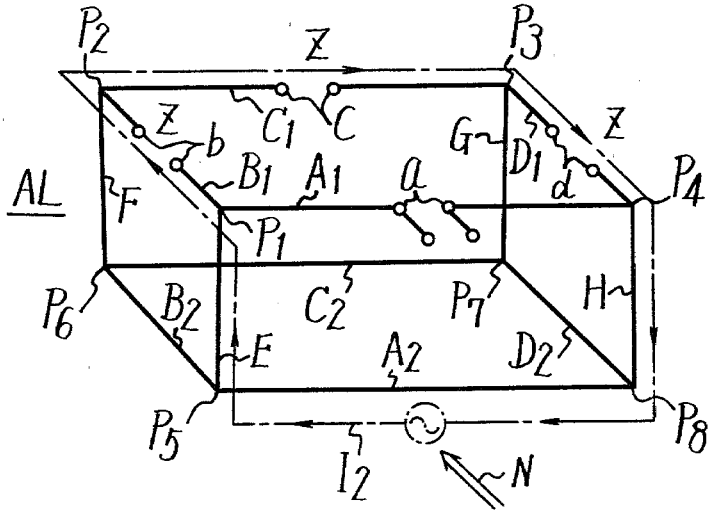

At this time, as shown in FIG. 8, a current $I_2$ flows through the closed loop consisting of the conductors $A_2$-E-$B_1$-$C_1$-$D_1$-H-$A_2$. No impedance element with the impedance $Z=\infty$ is inserted into the loop through which the current $I_1$ flows as shown in FIG. 6, while impedance elements with the impedance $Z=\infty$ are inserted into the loop through which the current $I_2$ flows as shown in FIG. 8. Therefore, $I_1>>I_2$ is established. Thus, the current $I_2$ can be neglected and hence a loop antenna is formed by the loop through which the current $I_1$ flows as shown in FIG. 6.

Figure 9:
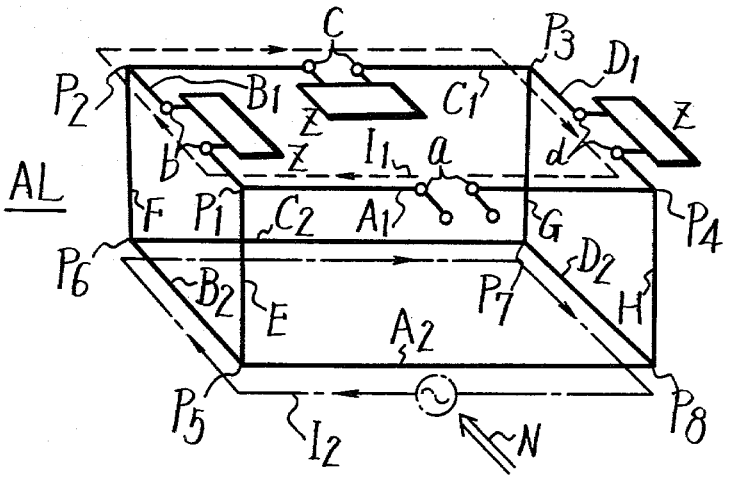

FIG. 9 shows such a case where the point a is selected as the feeding point, an incoming electric wave with the frequency of about 130 $MH_z$ arrives perpendicular to the plane including the connection points $P_1$, $P_4$, $P_8$ and $P_5$ as indicated by an arrow N and the plane of polarization of the electric field is parallel to the conductor $A_1$.

At this time, $\beta'l$ becomes $0.65\pi(\beta'l=0.65\pi)$ and $Z_r$ is set zero($Z_4=0$) similarly. Also, W is 300Ω as set forth above. Thus, $Z_{in}$ of the equation (1) becomes as follows:

$$Z_{in} = j\,W \tan \beta' l = j\,413\ (\Omega) \tag{9}$$

Accordingly, an impedance element with the impedance $Z=j413(\Omega)$ is equivalently connected to each of the feeding points b, c and d.

Figure 10:
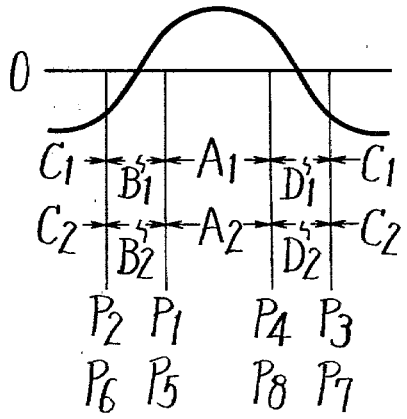

In this case, as shown in FIG. 9, a current $I_1$ flows through the closed loop consisting of the conductors $A_1$-$B_1$-$C_1$-$D_1$-$A_1$ and the current distribution thereof becomes as shown in the graph of FIG. 10, namely just one wave of the current with the frequency of 130 $MH_z$ is distributed. From the graph of FIG. 10, it will be clear that the current $I_1$ presents the positive and negative peaks at the center portions of the conductors $A_1$ and $C_1$ and becomes zero at the center portions of the conductors $B_1$ and $D_1$, respectively.

At this time, as shown in FIG. 9, a current $I_2$ flows through the closed loop consisting of the conductors $A_2$-$B_2$-$C_2$-$D_2$-$A_2$ and the current distribution thereof becomes as shown in the graph of FIG. 10, namely just one wavelength of the current with the frequency of 130 $MH_z$ is distributed. From the graph of FIG. 10, it will be clear that the current $I_2$ presents the positive and negative peaks at the center portions of the conductors $A_2$ and $C_2$ and becomes zero at the center portions of the conductors $B_2$ and $D_2$, respectively.

In this case, no current flows through the conductors E, F, G and H so that a vertically stacked antenna is formed of two loops through which the currents $I_1$ and $I_2$ flow respectively.

Figure 11:
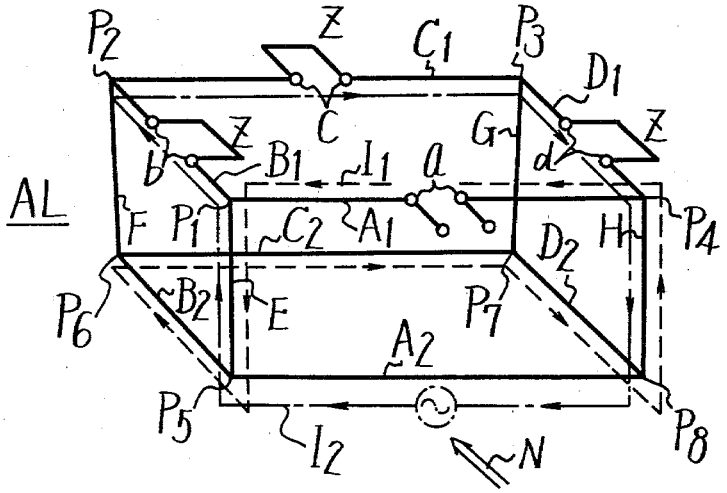

FIG. 11 shows a case where the point a is selected as the feeding point, an incoming electric wave with the frequency of about 200 $MH_z$ arrives perpendicular to the plane including the connection points $P_1$, $P_4$, $P_8$ and $P_5$ as indicated by an arrow N and the plane of polarization of the electric field is parallel to the conductor $A_1$.

At this time, $\beta'l$ becomes $\pi(\beta'l=\pi)$ and $Z_r$ is set zero ($Z_r=0$) similarly. Also, W is 300Ω as set forth above. Thus, $Z_{in}$ of the equation (1) becomes as follows:

$$Z_{in} = j\,W \tan \beta' l = 0\ (\Omega) \tag{10}$$

Accordingly, an impedance element with the impedance $Z=0(\Omega)$ is equivalently connected to each of the feeding points b, c and d, namely each of these feeding points is short-circuited.

Figure 12:
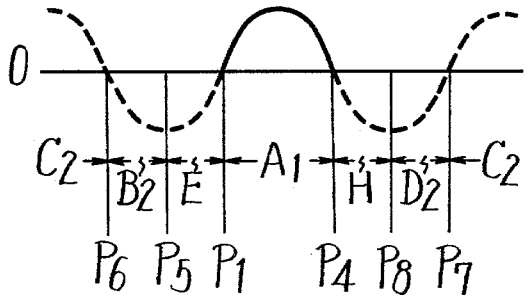

In this case, as shown in FIG. 11, a current $I_1$ flows through the closed loop consisting of the conductors $A_1$-E-$B_2$-$C_2$-$D_2$-H-$A_1$ and the current distribution thereof becomes as shown in the graph of FIG. 12, namely two wavelength of the current with the frequency of 200 $MH_z$ are distributed. From the graph of FIG. 12, it will be clear that the current $I_1$ presents the positive and negative peaks at the center portions of the conductors $A_1$ and $C_2$ and at the connection points $P_5$, $P_8$ and becomes zero at the connection points $P_6$, $P_1$, $P_4$ and $P_7$, respectively.

Figure 13:
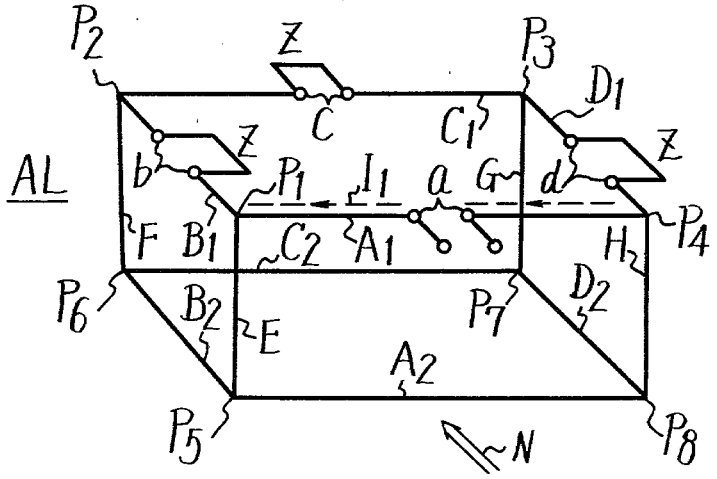

At this time, as shown in FIG. 11, a current $I_2$ flows through the closed loop consisting of the conductors $A_2$-E-$B_1$-$C_1$-$D_1$-H-$A_2$. However, through the conductors E and H the currents $I_1$ and $I_2$ flow respectively in the opposite directions so that they are cancelled. As a result, as shown in FIG. 13, ½ wave of the current $I_1$ at a frequency of 200 $MH_z$ is distributed to only the conductor $A_1$ (shown in the graph of FIG. 12 by the solid line curve) and hence a dipole antenna is formed by the conductor $A_1$.

Figure 14:
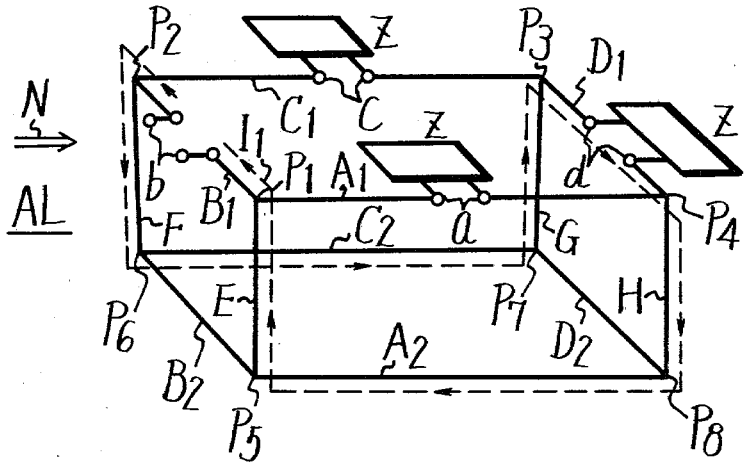

FIG. 14 shows a case where the point b is selected as the feeding point, an incoming electric wave with the frequency of about 75 $MH_z$ arrives perpendicular to the plane including the connection points $P_1$, $P_5$, $P_6$ and $P_2$ as indicated by an arrow N and the plane of polarization of the electric field is parallel to the conductor $B_1$.

At this time, $\beta'l$ becomes $0.375\pi(\beta'l=0.375)$ and $Z_r$ is set zero ($Z_r=0$) similarly. Also, W is 300Ω as set forth above. Thus, $Z_{in}$ of the equation (1) becomes as follows:

$$Z_{in} = j\,W \tan \beta' l = j\,724\ (\Omega) \quad (11)$$

Accordingly, an impedance element with the impedance $Z=j724\ (\Omega)$ is equivalently connected to each of the feeding points c, d and a.

Figure 15:
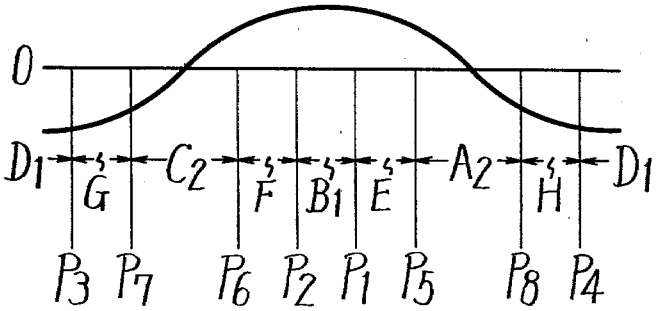

In this case, as shown in FIG. 14, a current $I_1$ flows through the closed loop consisting of the conductors $B_1$-F-$C_2$-G-$D_1$-H-$A_2$-E-$B_1$ and the current distribution thereof becomes as shown in the graph of FIG. 15, namely just one wave of the current with the frequency of 75 $MH_z$ is distributed. From the graph of FIG. 15, it will be clear that the current $I_1$ presents the positive and negative peaks at the center portions of the conductors $B_1$ and $D_1$ and becomes zero at the center portions of the conductors $C_2$ and $A_2$, respectively.

Figure 16:
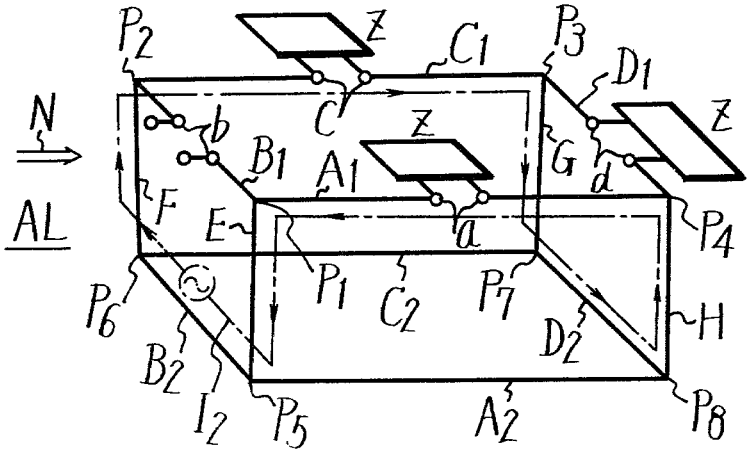

At this time, as shown in FIG. 16, a current $I_2$ flows through the closed loop consisting of the conductors $B_2$-F-$C_1$-G-$D_2$-H-$A_1$-E-$B_2$. In this case, one impedance element with the impedance Z is inserted into the loop through which the current $I_1$ flows as shown in FIG. 14, while two impedance elements with the impedance Z are inserted into the loop through which the current $I_2$ flows as shown in FIG. 16. Therefore, $I_1 > I_2$ is established. Thus, if the current $I_2$ is neglected, a loop antenna is formed of the loop through which the current $I_1$ flows as shown in FIG. 14.

Figure 17:
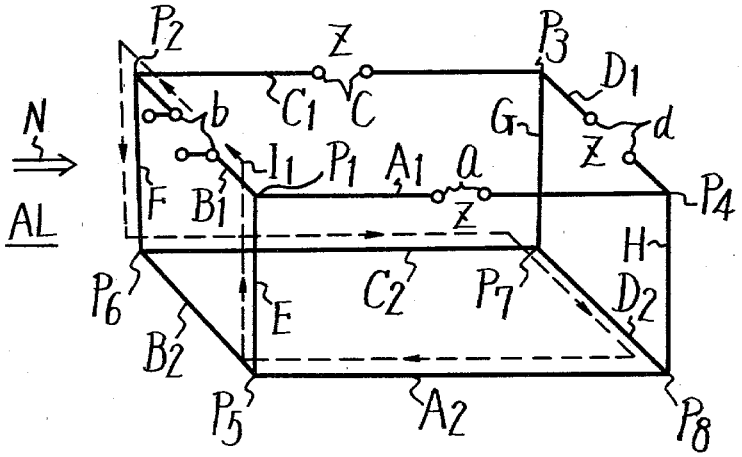

FIG. 17 shows a case where the point b is selected as the feeding point, an incoming electric wave with the frequency of about 100 $MH_z$ arrives perpendicular to the plane including the connection points $P_1$, $P_5$, $P_6$ and $P_2$ as indicated by an arrow N and the plane of polarization of the electric field is parallel to the conductor $B_1$.

At this time, $\beta' l$ becomes $0.5\pi$ ($\beta' l = 0.5\pi$) and $Z_r$ is set zero ($Z_r=0$) similarly. Also, W is 300 Ω as described above. Thus, $Z_{in}$ of the equation (1) becomes as follows:

$$Z_{in} = j\,W \tan \beta' l = \infty\ (\Omega) \quad (12)$$

Accordingly, an impedance element with the impedance $Z=\infty(\Omega)$ is equivalently connected to each of the feeding points c, d and a, namely each of these feeding points is opened.

Figure 18:
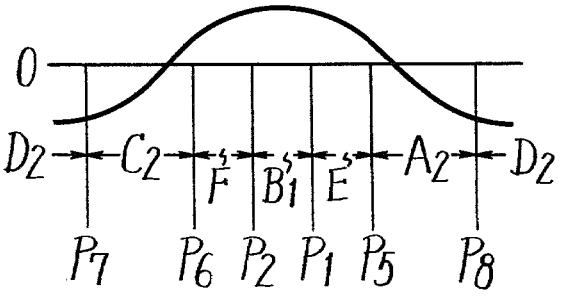

In this case, as shown in FIG. 17, a current $I_1$ flows through the closed loop consisting of the conductors $B_1$-F-$C_2$-$D_2$-$A_2$-E-$B_1$ and the current distribution thereof becomes as shown in the graph of FIG. 18, namely just one wavelength of the current with the frequency of 100 $MH_z$ is distributed. From the graph of FIG. 18, it will be clear that the current $I_1$ presents the positive and negative peaks at the center portions of the conductors $B_1$ and $D_2$ and becomes zero at certain points of the conductors $C_2$ and $A_2$, respectively.

Figure 19:
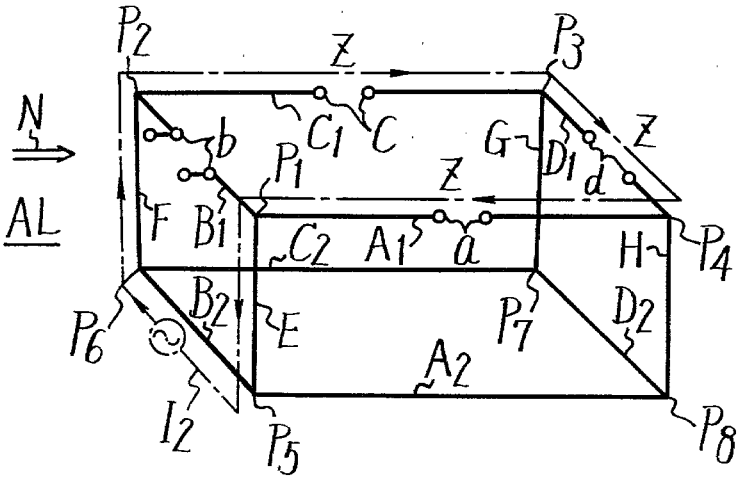

At this time, as shown in FIG. 19, a current $I_2$ flows through the closed loop consisting of the conductors $B_2$-F-$C_1$-$D_1$-$A_1$-E-$B_2$. No impedance element with the impedance $Z=\infty$ is inserted into the loop through which the current $I_1$ flows as shown in FIG. 17, while impedance elements with the impedance $Z=\infty$ are inserted into the loop through which the current $I_2$ flows as shown in FIG. 19. Therefore, $I_1 >> I_2$ is established. Thus, the current $I_2$ can be neglected, and accordingly, a loop antenna is formed by the loop through which the current $I_1$ flows shown in FIG. 17.

Figure 20:
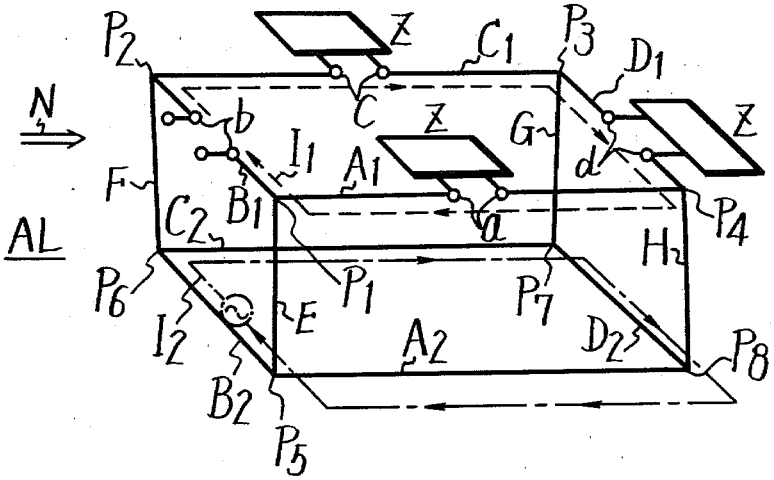

FIG. 20 shows a case where the point b is selected as the feeding point, an incoming electric wave with the frequency of about 130 $MH_z$ arrives perpendicular to the plane including the connection points $P_1$, $P_5$, $P_6$ and $P_2$ as indicated by an arrow N and the plane of polarization of the electric field is parallel to the conductor $B_1$.

At this time, $\beta' l$ becomes $0.65\pi$($\beta' l = 0.65\pi$) and $Z_r$ is set zero ($Z_r=0$) similarly. Also, W is 300 Ω as set forth above. Thus, $Z_{in}$ of the equation (1) becomes as follows:

$$Z_{in} = j\,W \tan \beta' l = j\,413\ (\Omega) \quad (13)$$

Accordingly, an impedance element with the impedance $Z=j413(\Omega)$ is equivalently connected to each of the feeding points c, d and a.

Figure 21:
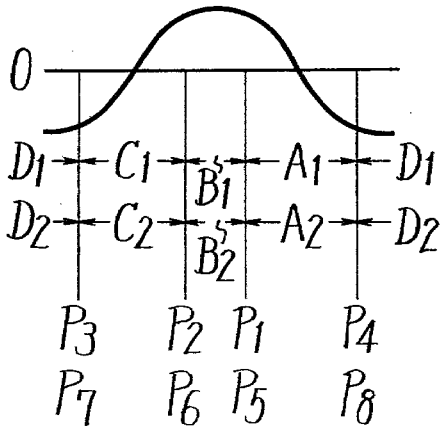

In this case, as shown in FIG. 20, a current $I_1$ flows through the closed loop consisting of the conductors $B_1$-$C_1$-$D_1$-$A_1$-$B_1$ and the current distribution thereof becomes as shown in the graph of FIG. 21, namely just one wavelength of the current with the frequency of 130 $MH_z$ is distributed. From the graph of FIG. 21, it will be clear that the current $I_1$ presents the positive and negative peaks at the center portions of the conductors $B_1$ and $D_1$ and becomes zero at the center portions of the conductors $C_1$ and $A_1$, respectively.

At this time, as shown in FIG. 20, a current $I_2$ flows through the closed loop consisting of the conductors $B_2$-$C_2$-$D_2$-$A_2$-$B_2$ and the current distribution thereof becomes as shown in the graph of FIG. 21 from which it will be apparent that one wave of the current with the frequency of 130 $MH_z$ is distributed and that the current $I_2$ presents its positive and negative peaks at the center portions of the conductors $B_2$ and $D_2$ and becomes zero at the center portions of the conductors $C_2$ and $A_2$, respectively.

In this case, no current flows through each of the conductors E to H so that a vertically stacked loop antenna is formed of the two loops through which the currents $I_1$ and $I_2$ flow respectively.

In fact, in place of selecting the point b as the feeding point, if the point a as the feeding point, an output with a higher level can be provided.

Further, since the feeding points c and a and the feeding points d and b are respectively provided at the opposite sides and symmetrically, when an output is derived from the points c and d, the respective directivities thereof are different by merely 180° from those at the points a and b. Therefore, the description to derive an output from the points c and d will be omitted.

Figure 22:
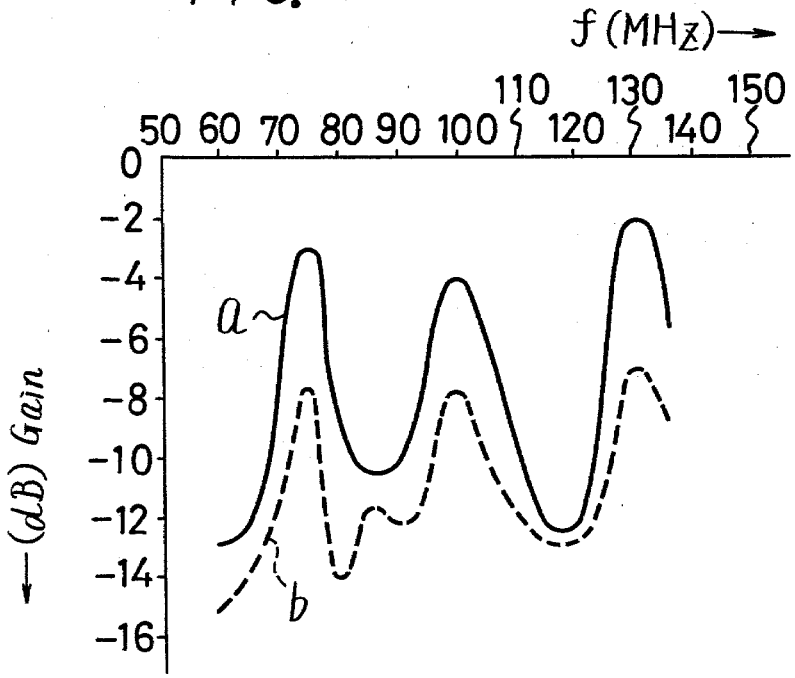
FIGS. 22 and 23 are respectively graphs each showing the gain to frequency characteristic of the loop antenna apparatus of the invention.
Figure 23:
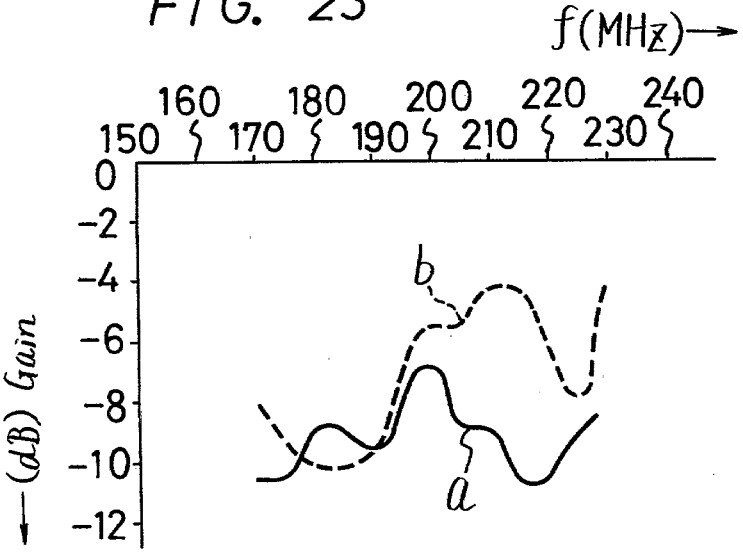
Figure 24:
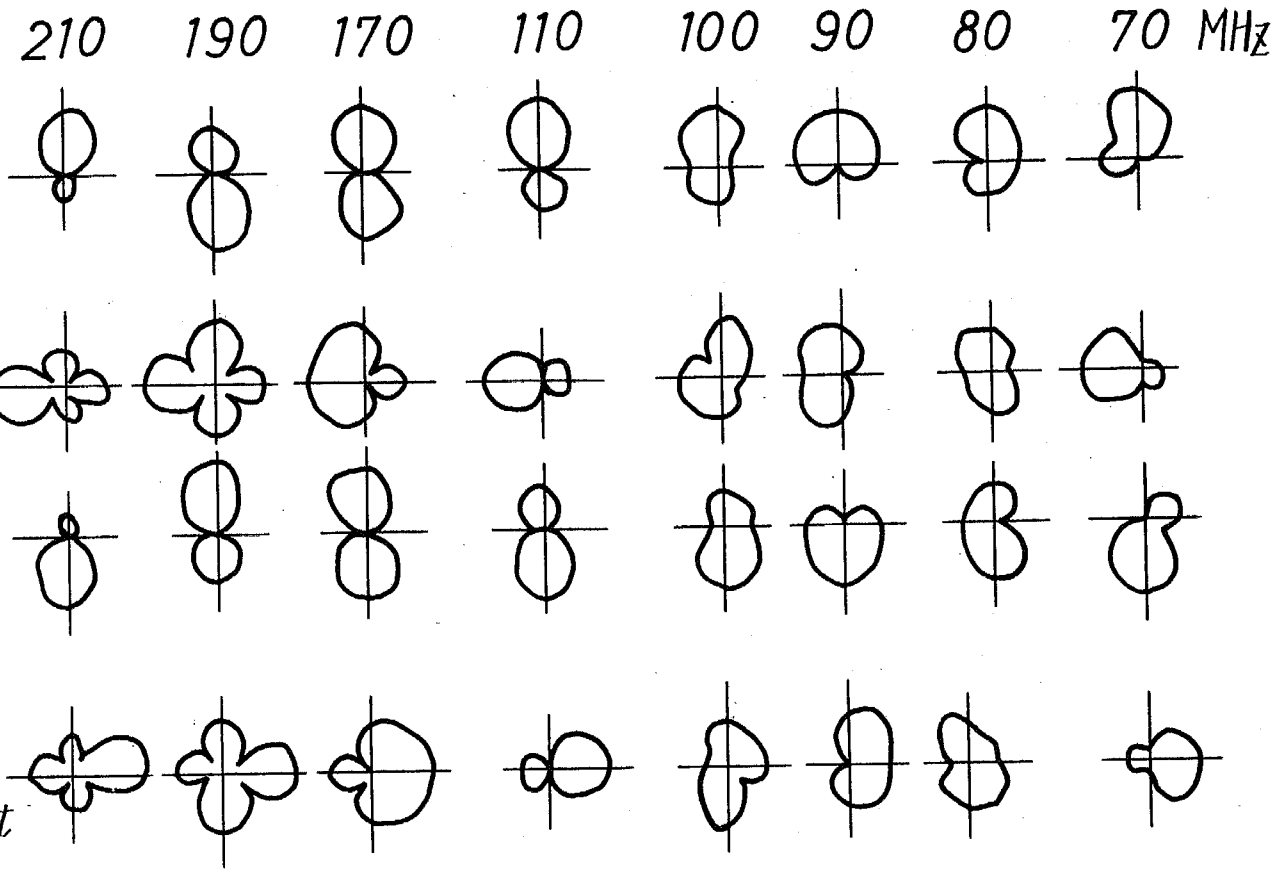
FIGS. 24A to 24D are respectively graphs each showing the directivity characteristic of the loop antenna apparatus of the invention.

FIGS. 22 and 23 are respectively graphs which show the frequency characteristics of the antenna gain in the vicinity of 50 to 150 $MH_z$ and 150 to 250 $MH_z$ by curves a and b.

FIGS. 24A, 24B, 24C and 24D are respectively directivity characteristic curves for such cases where the feeding point at which the output is obtained from the antenna conductor is respectively changed from point a to point d through points b and c and also the frequency of the coming electric wave is varied between 70, 80, 90, 100, 110, 170, 190 and 210 $MH_z$.

Figure 25:
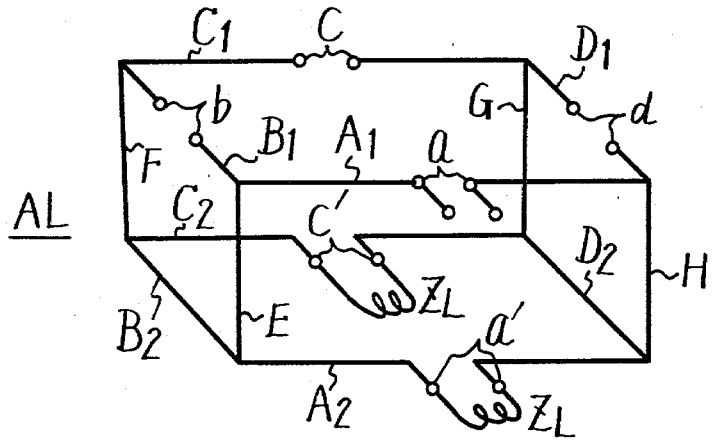
FIG. 25 is a perspective view showing the antenna conductive portion of another example of the loop antenna apparatus according to the invention.
Figure 26:
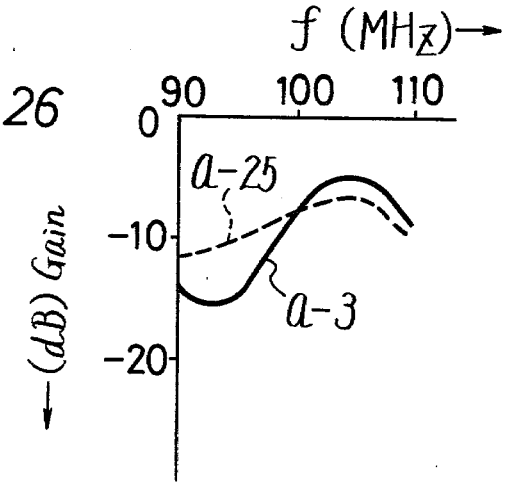
FIGS. 26, 27, 28 and 29 are respectively graphs each showing the gain to frequency characteristic of the loop antenna apparatus of the invention shown in FIG. 25.
Figure 27:
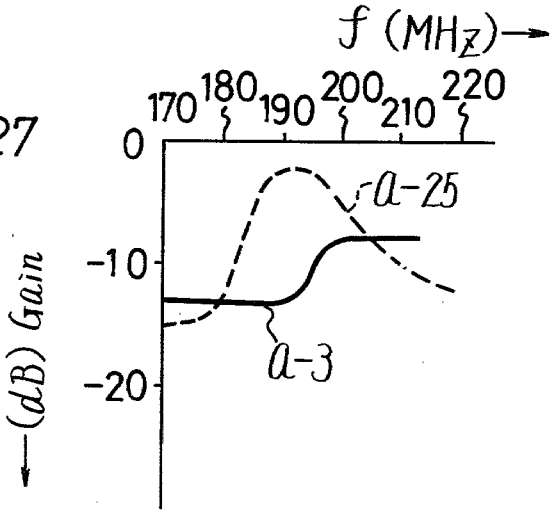

If an appropriate impedance element is loaded on the conductive portion of either one of the antenna conductive portion AL, the frequency characteristic of the antenna gain can be improved. For example, if as shown in FIG. 25 additional feeding points a′ and c′ are respectively provided on the center portions of the conductors $A_2$ and $C_2$ and impedance elements each with an impedance $Z_{L=j}327\Omega$ (upon the signal with the frequency of 100 $MH_z$), which impedance elements are respectively made of appropriate feeders similar to those connected to the feeding points a to d, are respectively connected to the additional feeding points a' and c' the frequency characteristic of the antenna gain in the case where an output is derived from the feeding point a shown in FIG. 25 are improved as shown in the graphs of FIGS. 26 and 27 by dotted line curves a-25 where solid line curves a-3 correspond to that of FIG. 3. In this case, the frequency range where the curves a-25 is improved as compared with the curves a-3 in antenna gain is between 90 $MH_z$ and 100 $MH_z$ and between 180 $MH_z$ and 205 $MH_z$, respectively.

Figure 28:
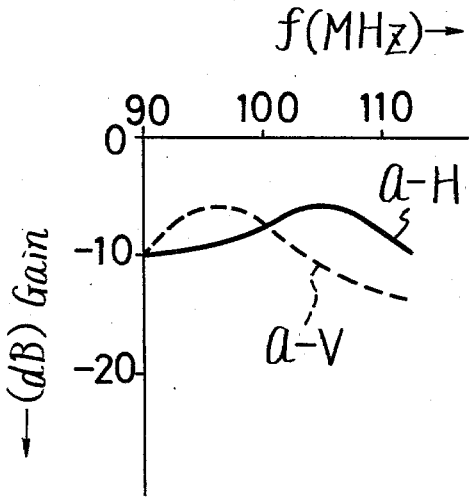

FIG. 28 is the graph showing the frequency characteristic curves of the antenna gain as a-H and a-V in the case that, in the antenna conductive portion AL of FIG. 25, an output is derived from the feeding point a and the plane of polarization of the electric field of the coming electric wave is parallel and vertical to the conductor $A_1$.

Figure 29:
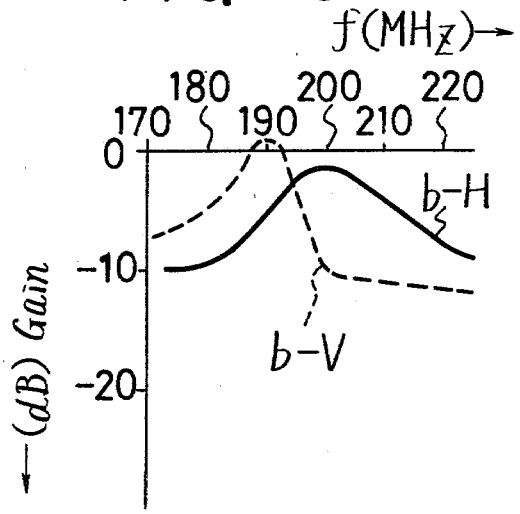

FIG. 29 is the graph showing the frequency characteristic curves of the antenna gain as b-H and b-V in the case that, in the antenna conductive portion AL of FIG. 25, an output is derived from the feeding point b and the plane of polarization of the electric field of the coming electric wave is parallel and vertical to the conductor $B_1$.

Therefore, it will be understood that the loop antenna apparatus of the present invention presents a broad frequency band for each of the horizontal and vertical polarized waves.

Figure 30:
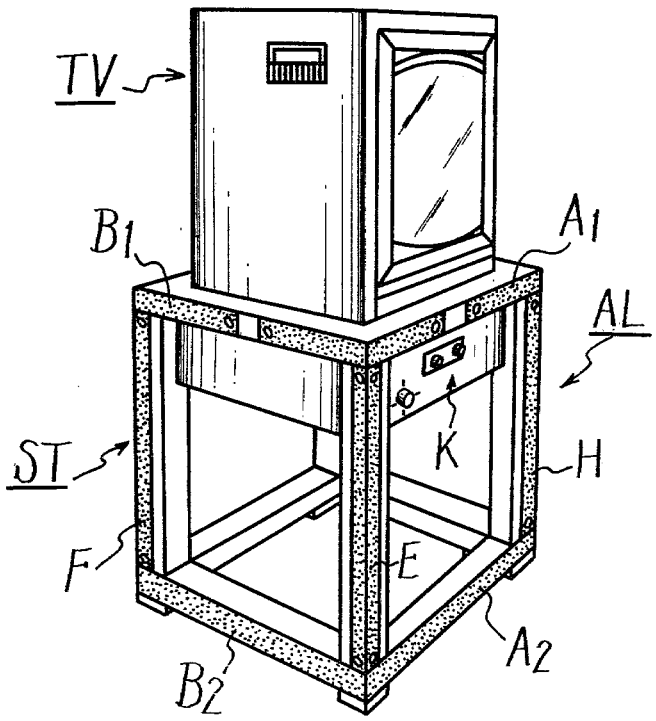
FIG. 30 is a perspective view showing the practical construction of one example of the loop antenna apparatus according to the invention.

Turning to FIG. 30, a more practical example of the loop antenna apparatus according to the present invention will be now described. In the figure, reference letters TV generally designate a television receiver and ST a base of stand on which the television receiver TV is located. In this example, the stand ST is formed of a top plate with the shape of a rectangular parallelepiped and a plurality of frames. A metal plate which is made of aluminum, copper or the like and cut to have a predetermined width is bonded to each of the edges of the top plate, and then the stand ST is used to support the antenna conductive portion AL of the loop antenna apparatus described above. Thus, by this example of the invention, no space for the antenna apparatus is required and the stand ST is on the other hand reinforced by the antenna conductive portion AL. In FIG. 30, the conductors $A_1$, $B_1$, E, F, H, $A_2$ and $B_2$ are shown by way of example. Further, in FIG. 30 a signal feeding circuit K (change-over knob and output terminals are also shown) is provided on a part of the stand ST at the front of the television receiver TV. However, the relative position of the signal feeding circuit K to the television receiver TV may be freely changed, for example, the television receiver TV can be located on the stand ST at such a position that the signal feeding circuit K provided on the stand ST corresponds to, for example, the rear side of the television receiver TV.

It may be also possible that the antenna conductive portion AL and the signal feeding circuit K are mounted on the cabinet itself of the television receiver TV.

According to the present invention described as above, such a loop antenna apparatus can be provided which is of a broad band and whose directivity and directivity characteristic can be easily changed over as described above.

The present invention can be applied not only to a receiving antenna such as the television antenna, FM radio antenna and so on but also to a transmission antenna.

Further, it is to limit the shape of the antenna conductive portion to a rectangular parallelepiped but it is possible to form the antenna conductive portion in various shapes such as a straight lines and curved lines (circle, ellipse or the like).

It will be apparent that many modifications and variations could be effected by one skilled in the art without departing from the spirits or scope of the novel concepts of the present invention so that the spirits or scope of the invention should be determined by the appended claims only.

We claim as our invention:

1. A loop antenna apparatus comprising:

a main conductive loop arranged on a first flat surface;

first and second supplemental conductive loops connected to said main conductive loop and arranged on second and third flat surfaces perpendicular to said first flat surface, respectively;

third supplemental conductive loop connected to said first and second supplemental conductive loops and arranged on a fourth flat surface parallel to said first flat surface and perpendicular to said second and third flat surfaces;

first and second signal feeding points provided in said main conductive loop and said first supplemental conductive loop, respectively;

an output terminal; and means for selectively connecting one of said first and second feeding points to said output terminal.

2. A loop antenna apparatus according to claim 1, wherein said first, second, third and fourth flat surfaces define a rectangular parallelepiped.

3. A loop antenna apparatus comprising:

a top plate and a plurality of frames arranged to define a rectangular parallelepiped having six planes;

a plurality of conductive plates mounted on said top plate and said plurality of frames near the peripheral portions of said six planes, said plurality of conductive plates forming a main conductive loop on a first plane of said six planes and a plurality of supplemental conductive loops formed on different planes of said six ones from said first plane;

a plurality of signal feeding points provided in different loops of said main and supplemental conductive loops;

an output terminal; and means for selectively connecting one of said plurality of signal feeding points to said output terminal.

4. A loop antenna apparatus according to claim 3, wherein said top plate and said plurality of frames are designed to form a television stand and output signals from said output terminal are supplied to said television receiver.

* * * * *